US010557692B1

(12) United States Patent
Amendola et al.

(10) Patent No.: US 10,557,692 B1
(45) Date of Patent: Feb. 11, 2020

(54) VIBRATION RESISTANT INITIATOR ASSEMBLY HAVING EXPLODING FOIL INITIATOR

(71) Applicant: Reynolds Systems, Inc., Middletown, CA (US)

(72) Inventors: Michael A. Amendola, Middletown, CA (US); Richard K. Reynolds, Middletown, CA (US); Christopher J. Nance, Middletown, CA (US)

(73) Assignee: REYNOLDS SYSTEMS, INC., Middletown, CA (US)

( * ) Notice: Subject to any disclaimer, the term of this patent is extended or adjusted under 35 U.S.C. 154(b) by 174 days.

(21) Appl. No.: 15/600,893

(22) Filed: May 22, 2017

(51) Int. Cl.
*F42B 3/10* (2006.01)
*F42B 3/12* (2006.01)
*F42B 3/195* (2006.01)

(52) U.S. Cl.
CPC ..... *F42B 3/10* (2013.01); *F42B 3/12* (2013.01); *F42B 3/128* (2013.01); *F42B 3/195* (2013.01)

(58) Field of Classification Search
CPC .... F42B 3/10; F42B 3/12; F42B 3/125; F42B 3/128
USPC .... 102/202.5–202.9, 202.11, 202.14, 275.11
See application file for complete search history.

(56) References Cited

U.S. PATENT DOCUMENTS 5,175,390 A * 12/1992 Peretz ..... F42B 3/16 102/202.13
6,851,370 B2 2/2005 Reynolds et al.
6,923,122 B2 8/2005 Hennings et al.
7,430,963 B2 10/2008 Hennings et al.
7,571,679 B2 8/2009 Nance
7,661,362 B2 2/2010 Hennings et al.
7,690,303 B2 4/2010 Reynolds et al.
7,987,787 B1 * 8/2011 Sudick ..... F42B 3/18 102/202.1
8,100,043 B1 1/2012 Nance et al.
8,276,516 B1 10/2012 Nance et al.
8,408,131 B1 4/2013 Nance
8,485,097 B1 7/2013 Nance et al.
8,573,122 B1 11/2013 Nance et al.
8,726,808 B1 5/2014 Nance
9,038,538 B1 5/2015 Nance et al.
9,500,448 B1 11/2016 Nance et al.

OTHER PUBLICATIONS

U.S. Appl. No. 14/501,656, filed Sep. 30, 2014 entitled: "High G-Force Resistant Initiator Assembly Having An Exploding Foil Initiator".

* cited by examiner

*Primary Examiner* — Bret Hayes
(74) *Attorney, Agent, or Firm* — Harness, Dickey & Pierce, P.L.C.

(57) ABSTRACT

An initiator assembly that includes a housing assembly, an exploding foil initiator, an input charge and an output charge. The exploding foil initiator is received in the housing assembly and includes a bridge, a flyer and a barrel. The flyer overlies the bridge and is disposed between the barrel and the bridge. The barrel defines a barrel aperture. The input charge, which is formed of a secondary explosive, is received in the housing assembly and is disposed in-line with the barrel aperture. The output charge assembly is received in the housing assembly and is segregated from the input charge.

30 Claims, 7 Drawing Sheets

VIBRATION RESISTANT INITIATOR ASSEMBLY HAVING EXPLODING FOIL INITIATOR

FIELD

The present disclosure relates to a vibration resistant initiator assembly having an exploding foil initiator.

BACKGROUND

This section provides background information related to the present disclosure which is not necessarily prior art.

Initiator assemblies are employed to detonate an input charge to release energy that is subsequently employed to initiate detonation, deflagration or combustion in an output charge. There is a trend in the field of initiator assemblies to employ an exploding foil initiator as the means for initiating detonation of the input charge. Electrical energy input to an exploding foil initiator causes a thin metal bridge to vaporize, which propels a flyer through a barrel and into contact with the input charge. The flyer is typically formed of a relatively thin plastic material and must be accelerated over a relatively short distance (i.e., less than 0.050 inch) to a velocity that is sufficient to initiate the detonation of the input charge. Moreover, the flyer must strike the input charge in a manner that is perpendicular to the axis of the barrel to reduce the risk that contact between the flyer and the input charge will initiate detonation of the input charge.

In situations where the initiator assembly is subjected to a relatively large amount of vibration, there is a risk that portions of the output charge will break apart and migrate within the initiator assembly onto the flyer. This situation is detrimental because it greatly increases the risk that the exploding foil initiator will not be able to detonate the input charge. In this regard, if even a relatively small mass of the material that forms the output charge falls onto the flyer, the additional mass could prevent the flyer from being accelerated to a threshold velocity that is needed to cause the input charge to detonate and/or could cause the flyer to tilt relative to the longitudinal axis of the barrel so that the shock produced by contact between the flyer and the input charge is distributed over time (rather than all at once) so that the input charge is not shocked to a degree that initiates detonation of the input charge.

SUMMARY

This section provides a general summary of the disclosure, and is not a comprehensive disclosure of its full scope or all of its features.

In one form, the present teachings provide an initiator assembly that includes a housing, an exploding foil initiator, an input charge and an output charge. The housing assembly defines an interior cavity. The exploding foil initiator is received in the interior cavity and includes a bridge, a flyer and a barrel. The flyer overlies the bridge and is disposed between the barrel and the bridge. The barrel defines a barrel aperture. The input charge, which is formed of a secondary explosive, is received in the interior cavity and is disposed in-line with the barrel aperture. The output charge assembly is received in the interior cavity and is disposed in-line with the input charge on a side of the input charge that faces away from the exploding foil initiator. The output charge assembly has an output charge and a container. The output charge is formed of a secondary explosive. The container defines a closed volume into which the output charge is received.

In another form, the present teachings provide an initiator assembly that includes a housing assembly, an exploding foil initiator, an input charge and an output charge. The housing assembly defines a first cavity and a second cavity. The exploding foil initiator is received in the first cavity and has a bridge, a flyer and a barrel. The flyer overlies the bridge and is disposed between the barrel and the bridge. The barrel defines a barrel aperture. The input charge is received in the first cavity and is disposed in-line with the barrel aperture. The input charge is formed of a secondary explosive. The output charge is disposed in the second cavity and is formed of a secondary explosive.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
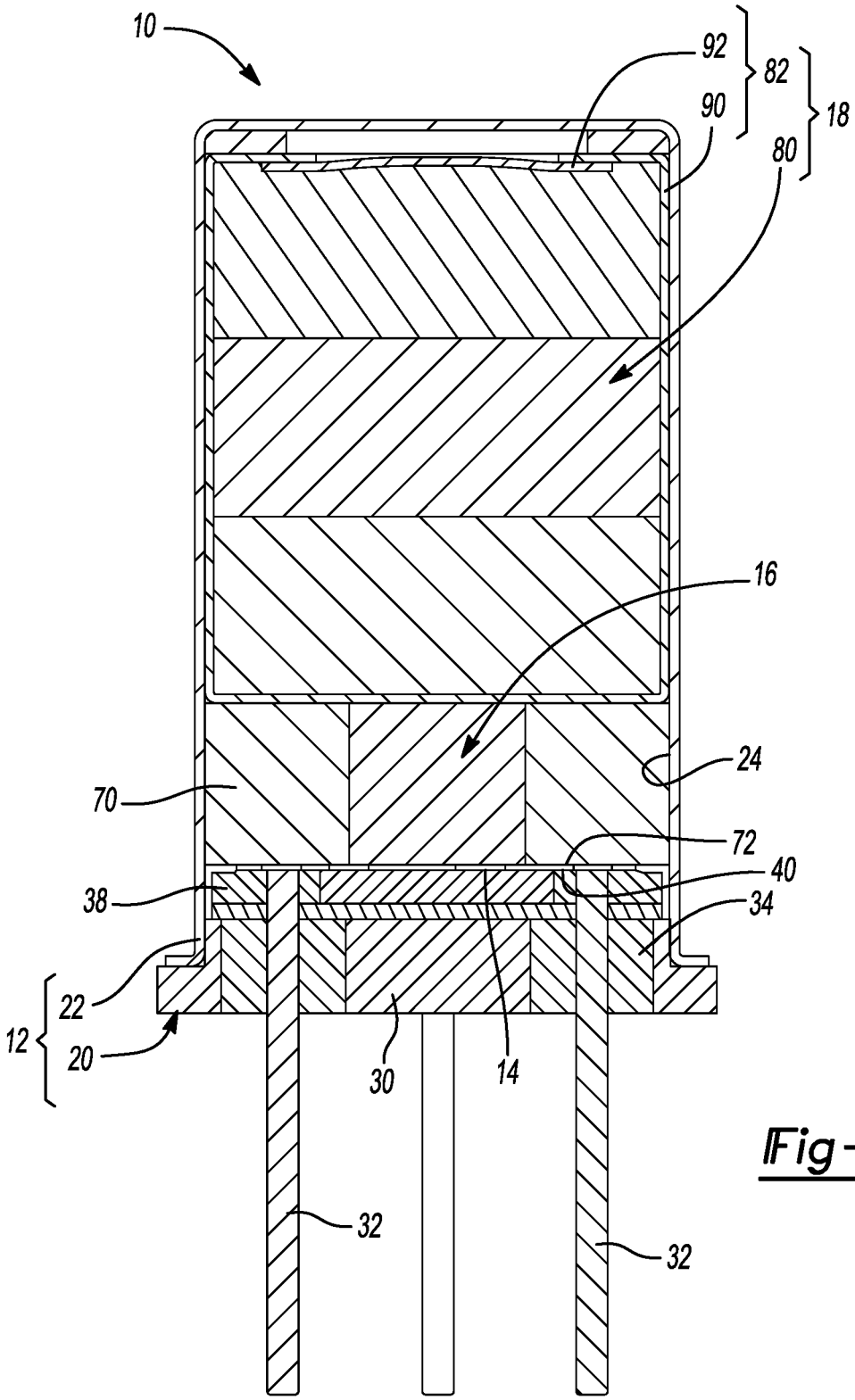
FIG. 1 is a longitudinal section view of a first initiator assembly constructed in accordance with the teachings of the present disclosure.

With reference to FIG. 1 of the drawings, an exemplary initiator assembly constructed in accordance with the teachings of the present disclosure is generally indicated by reference numeral 10. The initiator assembly 10 can include a housing assembly 12, an exploding foil initiator 14, an input charge 16 and an output charge assembly 18. The housing assembly 12, the exploding foil initiator 14 and the input charge 16 can be generally similar to those described in U.S. Pat. No. 8,408,131 entitled "Energetic Material Initiation Device", which is incorporated by reference as if fully set forth in detail herein.

The housing assembly 12 can include a header assembly 20 and a cover 22 that can cooperate to define an interior cavity 24 into which the exploding foil initiator 14, the input charge 16 and the output charge assembly 18 can be received. With specific reference to FIGS. 2 and 3, the header assembly 20 can include a header body 30, a plurality of terminals 32, a plurality of seals 34, an insulating spacer 36, a frame member 38, and a plurality of contacts 40. The header body 30 can define a plurality of terminal apertures 42 through which the terminals 32 can be received. Each of the seals 34 can be received in an associated one of the terminal apertures 42 and can be sealingly engaged to the header body 30 and an associated one of the terminals 32. The insulating spacer 36 can be disposed over an interior surface 46 of the header body 30. The frame member 38 can be disposed over the insulating spacer 36 on a side opposite the interior surface 46. The frame member 38 can define an aperture 48 that can be sized to receive the exploding foil initiator 14 therein. The terminals 32 can extend through the insulating spacer 36 and the frame member 38.

Figure 2:
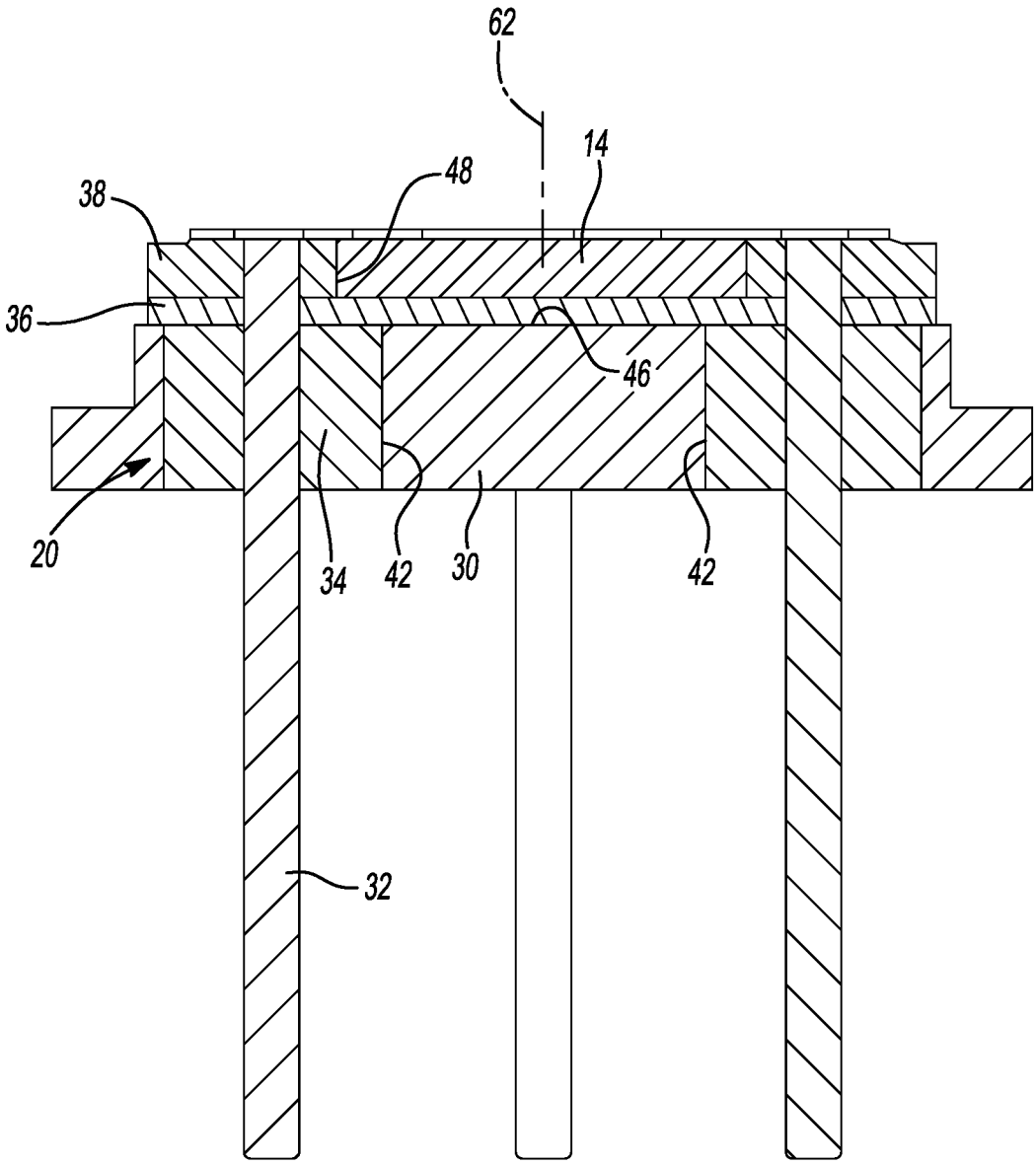
FIG. 2 is a longitudinal section view of a portion of the initiator assembly of FIG. 1, illustrating a header assembly in more detail.
Figure 3:
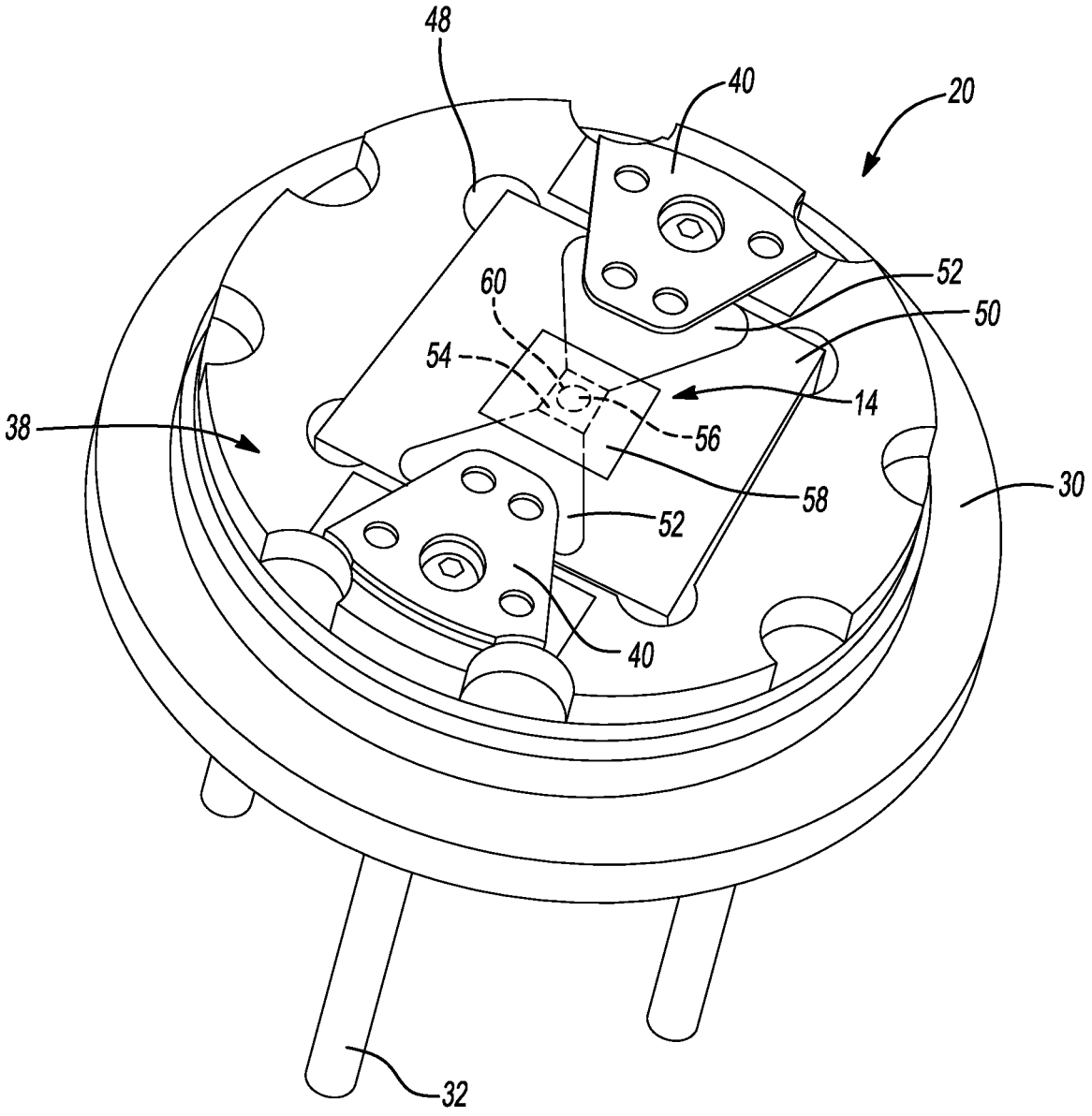
FIG. 3 is a perspective view of a portion of the initiator assembly of FIG. 1, illustrating the header assembly and an exploding foil initiator in more detail.

With specific reference to FIG. 3, the exploding foil initiator 14 can comprise a base 50, a plurality of bridge lands 52, a bridge 54, a flyer 56 and a barrel 58. The base 50 can be formed of a suitable structural and electrically insulating material, such as ceramic. The bridge lands 52 and the bridge 54 can be formed onto or otherwise secured to the base 50. The flyer 56 can be formed of a suitable material, such as a polyamide, and can be disposed over the bridge 54. The barrel 58 can be disposed over the flyer 56 on a side of the flyer 56 that faces away from the bridge 54. The barrel 58 can define a barrel aperture 60 having a longitudinal axis 62 (FIG. 2) that is disposed in-line with the flyer 56 and the bridge 54. Each of the contacts 40 can be electrically coupled to an associated one of the terminals 32 and an associated one of the bridge lands 52.

With reference to FIGS. 1 and 3, the input charge 16 can be formed of a suitable secondary explosive and can be disposed in-line with the barrel aperture 60 along the longitudinal axis 62 (FIG. 2). If desired, the input charge 16 can be retained in an annular sleeve 70 and an electrically insulating material 72 can be disposed between the contacts 40 and the annular sleeve 70. Optionally, a support member—can be disposed between the contacts 40 and the input charge 16 as is described in commonly assigned U.S. patent application Ser. No. 15/490,358 filed Apr. 18, 2017 and entitled "Initiator Assembly That Is Resistant To Shock", which is incorporated by reference as if fully set forth in detail herein.

Figure 4:
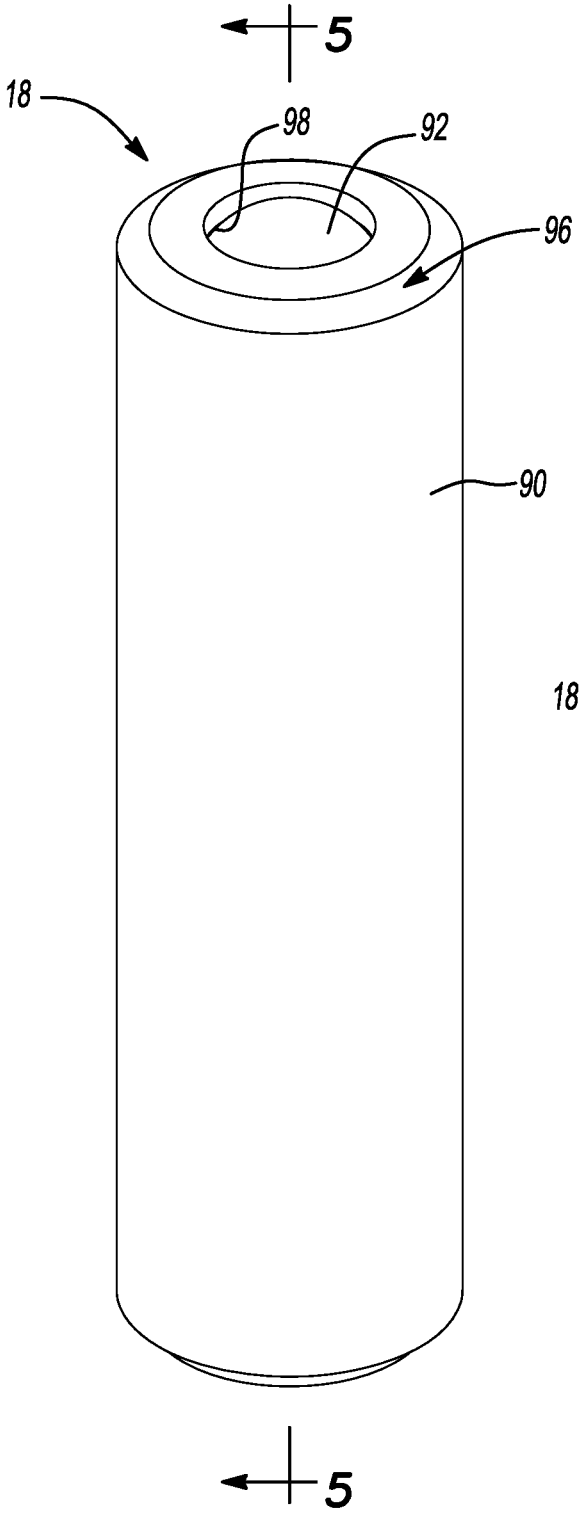
FIG. 4 is a perspective view of a portion of the initiator assembly of FIG. 1, illustrating an output charge assembly in more detail.
Figure 5:
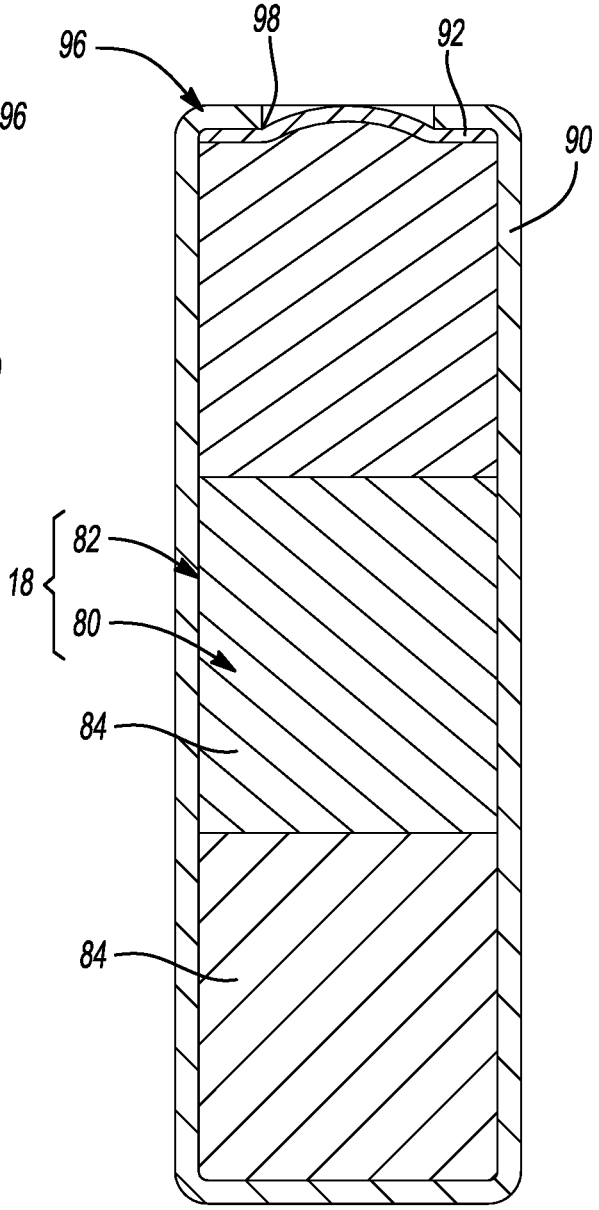
FIG. 5 is a longitudinal section view of the output charge assembly.

The output charge assembly 18 can be received in the interior cavity 24 and disposed in-line with the input charge 16 on a side of the input charge 16 that faces away from the exploding foil initiator 14. With reference to FIGS. 4 and 5, the output charge assembly 18 can include an output charge 80 and a container 82. The output charge 80 can be formed of a secondary explosive. The output charge 80 can be formed as one or more pellets 84 of a compacted powdered secondary explosive. If desired, each of the pellets 84 can be compacted along an axis that is parallel to (or coincident with) the longitudinal axis 62 (FIG. 2) of the barrel aperture 60.

The container 82 can define a closed volume into which the output charge 80 is received. In the example provided, the container 82 comprises a cup portion 90 and a lid portion 92. The cup portion 90 can be formed of a suitable material, such as a plastic or a metal (e.g., aluminum), in a suitable process, such as injection molding for plastics and drawing for metals. The output charge 80 can be received into the cup portion 90 and the lid portion 92 can be fixedly coupled to the cup portion 90 in a desired manner to secure the output charge 80 in the container 82. In the example provided, the lid portion 92 is received into the cup portion 90 over the output charge 80 and the cup portion 90 is deformed in a suitable manner, such as crimping (i.e., to form a crimp 96), to inhibit withdrawal of the lid portion 92 from the cup portion 90 and optionally to fixedly couple the lid portion 92 to the cup portion 90. It will be appreciated that other means may be employed for securing the lid portion 92 to the cup portion 90, including bonding. If desired, a force can be exerted through the container 82 to the output charge 80 during the assembly of the output charge assembly 18 that permits the container 82 to exert a compressive stress onto the output charge 80. The compressive stress could be directed along an axis that is coincident with the longitudinal axis 62 (FIG. 2) of the barrel aperture 60. Optionally, a sealant 98, such as a varnish, could be employed to seal the interface between the cup portion 90 and the lid portion 92.

With renewed reference to FIG. 1, it will be appreciated that placement of the output charge 80 in the container 82 isolates the output charge 80 from the exploding foil initiator 14 so that particles of the output charge 80 that may fragment from the remainder of the output charge 80 when the initiator assembly 10 experiences significant levels of vibration are maintained in the container 82 and cannot migrate through the interior cavity 24 and onto the flyer 56 (FIG. 3) where those particles may detrimentally affect the operation of the initiator assembly 10.

Figure 6:
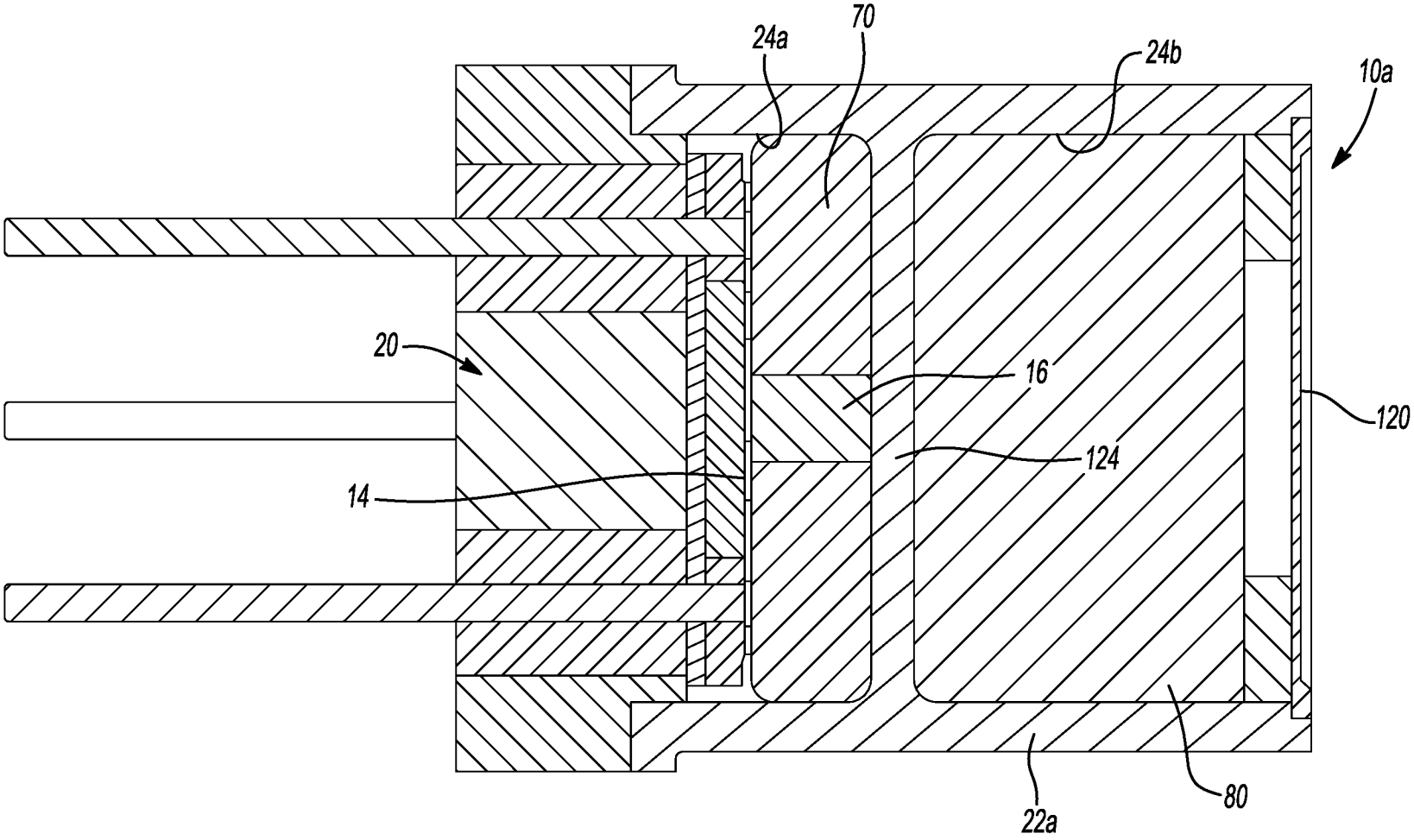
FIG. 6 is a longitudinal section view of a second initiator assembly constructed in accordance with the teachings of the present disclosure.
Figure 7:
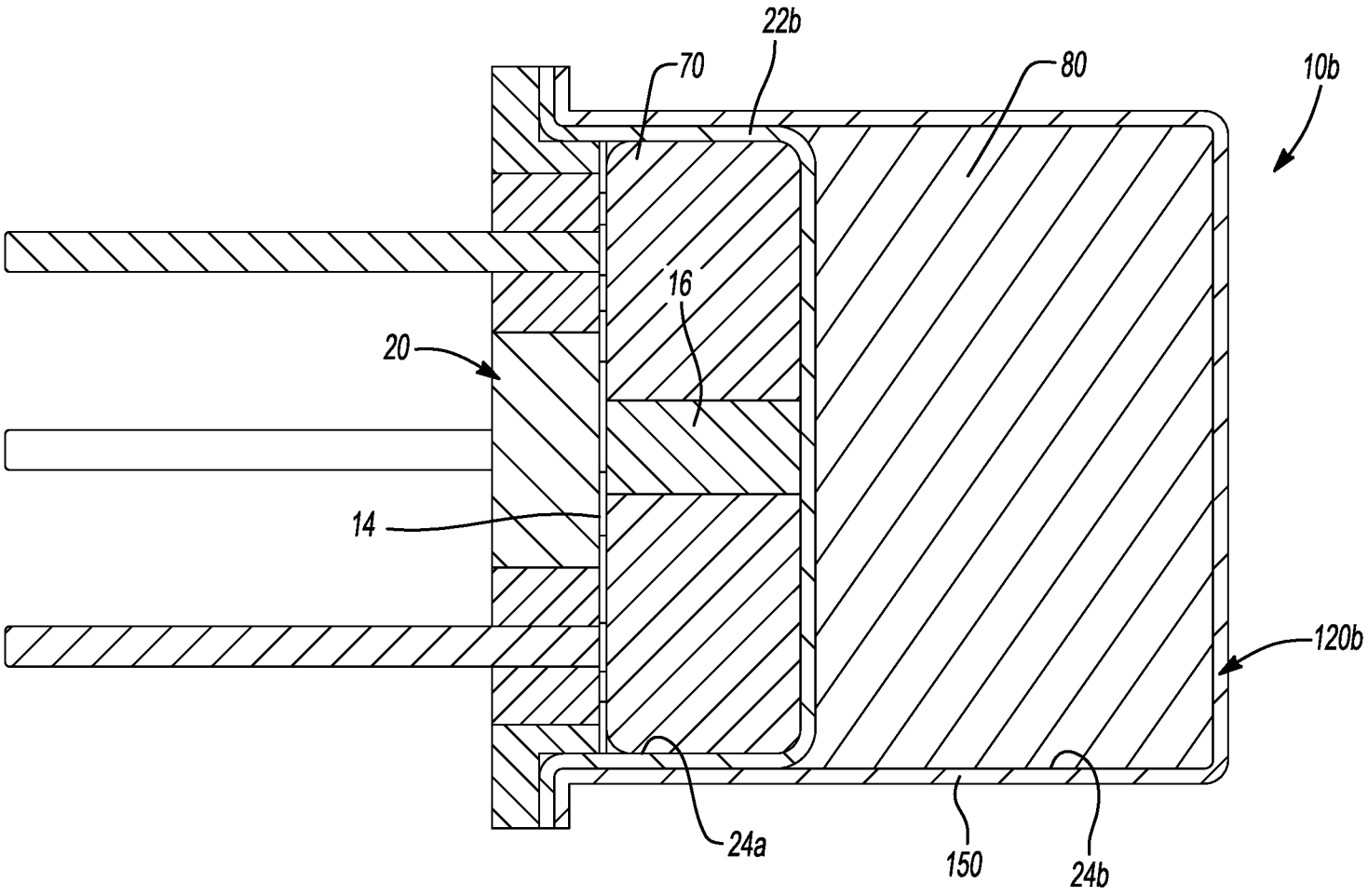
FIG. 7 is a longitudinal section view of a third initiator assembly constructed in accordance with the teachings of the present disclosure.
Figure 8:
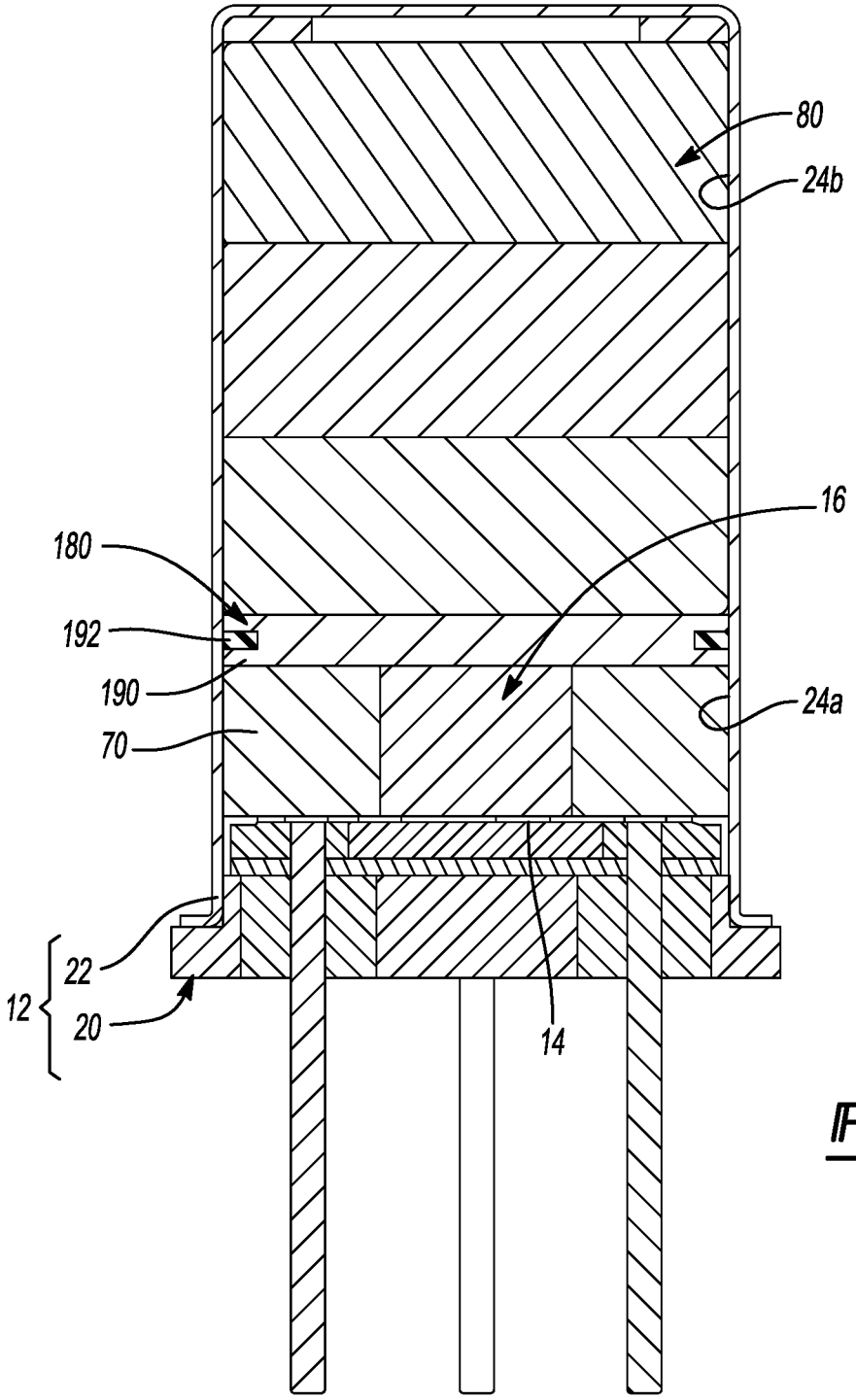
FIG. 8 is a longitudinal section view of a fourth initiator assembly constructed in accordance with the teachings of the present disclosure.

With reference to the examples of FIGS. 6 through 8, several other initiator assemblies constructed in accordance with the teachings of the present disclosure are depicted. In each of these examples, the initiator assembly depicted is generally similar to the initiator 10 (FIG. 1), except that the housing assembly defines a first cavity 24*a*, into which the exploding foil initiator 14 and the input charge 16 are received, and a second cavity 24*b* into which the output charge 80 is received, and the output charge 80 is not disposed in a container. In the example of FIG. 6, the housing assembly 12*a* of the initiator assembly 10*a* includes a header assembly 20, a cover 22*a* and a lid member 120. The header assembly 20 and the cover 22*a* can cooperate to form the first cavity 24*a*. The second cavity 24*b* can be formed (as a bore) into the cover 22*a* on an end over the cover 22*a* that faces away from the header assembly 20. The second cavity 24*b* can be configured to receive the output charge 80. The cover 22*a* can have an internal wall 124 that separates the second cavity 24*b* from the first cavity 24*a*. The lid member 120 can be fixedly coupled to the cover 22*a* to close the second cavity 24*b* to retain the output charge 80 in the second cavity 24*b* and segregate the output charge 80 from the first cavity 24*a*. In this particular example, the output charge 80 can only be formed of a secondary explosive.

In the example of FIG. 7, the initiator assembly 10*b* is similar to the initiator assembly 10*a* of FIG. 6, except that the lid member 120*b* has a cup-like body 150. The cup-like body 150 is configured to be received over the cover member 22*b* so that the cover 22*b* nests within the lid member 120*b*. In this example, some or all of the second cavity 24*b* can be formed by the lid member 120*b*. The cup-like body 150 can be secured to the cover 22*b* or the header assembly 20 in a desired manner, such as laser welding. It will be appreciated that immediately prior to the securing of the lid member 120*b* to the cover 22*b*, a force can be applied to the lid member 120*b* that tends to urge the lid member 120*b* in a direction toward the header assembly 20 to set the overall height of the initiator assembly 10*b* and/or to apply a compressive force to the output charge 80. The cover 22*b* and the lid member 120*b* can be secured to one another to maintain the initiator assembly 10*b* at the set overall height and/or maintain the compressive force on the output charge 80.

The housing assembly 12*c* in the example of FIG. 8 is similar to the housing assembly 12 of FIG. 1, except that it includes a seal assembly 180 that segregates the interior cavity into the first and second cavities 24*a* and 24*b*. The seal assembly 180 is disposed along the longitudinal axis 62 (FIG. 2) of the barrel aperture 60 (FIG. 3) between the input charge 16 and the output charge 80 and is sealingly engaged to the cover 22. The seal assembly 180 can include a body portion 190 and an annular seal member 192 that can be disposed about the body portion 190. The annular seal member 192 is configured to sealingly engage the body portion 190 and the interior surface of the cover 22.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An initiator assembly comprising:

a closed housing assembly that defines an interior cavity;

an exploding foil initiator received in the interior cavity, the exploding foil initiator having a bridge, a flyer and a barrel, the flyer overlying the bridge and being disposed between the barrel and the bridge, the barrel defining a barrel aperture;

an input charge received in the interior cavity and disposed in-line with the barrel aperture, the input charge being formed of a secondary explosive and being configured to be detonated by an impact of the flyer when the flyer is discharged through the barrel when the exploding foil initiator is operated; and an output charge assembly received in the interior cavity and disposed in-line with the input charge on a side of the input charge that faces away from the exploding foil initiator, the output charge assembly having an output charge and a closed container into which the output charge is received, the output charge being formed of a secondary explosive.

2. The initiator assembly of claim 1, wherein the container includes a cup portion and a lid portion that is fixedly secured to the cup portion, wherein the cup portion includes an annular wall, which is disposed about a circumference of the output charge, and a bottom wall that is fixedly coupled to the annular wall.

3. The initiator assembly of claim 2, wherein the annular wall and the bottom wall are formed of metal.

4. The initiator assembly of claim 3, wherein the metal comprises aluminum.

5. The initiator assembly of claim 2, wherein the lid portion is received into the annular wall.

6. The initiator assembly of claim 5, wherein the container exerts a compressive stress onto the output charge that is directed along an axis that is coincident with a longitudinal axis of the barrel aperture.

7. The initiator assembly of claim 5, wherein the annular wall defines a bore into which the output charge is received and wherein the lid portion is received in the bore.

8. The initiator assembly of claim 7, wherein the annular wall is deformed to inhibit withdrawal of the lid portion from the annular wall.

9. The initiator assembly of claim 2, wherein the output charge assembly further comprises a sealant that is disposed on the cup portion and the lid portion.

10. The initiator assembly of claim 9, wherein the sealant is a varnish.

11. The initiator assembly of claim 2, wherein the annular wall and the bottom wall are integrally and unitarily formed.

12. The initiator assembly of claim 2, wherein the lid portion is bonded to the annular wall.

13. The initiator assembly of claim 1, wherein the output charge is formed as a plurality of pellets, each of the pellets being formed of a compacted powdered material.

14. The initiator assembly of claim 13, wherein each of the pellets is compacted along an axis that is parallel to the longitudinal axis of the barrel aperture.

15. The initiator assembly of claim 1, further comprising a sleeve disposed about the input charge.

16. The initiator assembly of claim 1, wherein the initiator assembly is a detonator.

17. An initiator assembly comprising:

a sealed housing assembly having a header assembly and a cover, the header assembly having a header body, a plurality of terminals received through the header body, and a plurality of seals that are sealingly engaged to the header body and an associated one of the terminals, the cover being mounted to the header body and cooperating with the header assembly to form a first sealed cavity;

an exploding foil initiator received in the first sealed cavity and being mounted to the header assembly, the exploding foil initiator having a bridge, a flyer and a barrel, the bridge being electrically coupled to a pair of the terminals, the flyer overlying the bridge and being disposed between the barrel and the bridge, the barrel defining a barrel aperture;

an input charge received in the first sealed cavity and being disposed in-line with the barrel aperture, the input charge being formed of a secondary explosive and being configured to be detonated by an impact of the flyer when the flyer is discharged through the barrel when the exploding foil initiator is operated; and an output charge assembly coupled to the cover, the output charge assembly having an output charge and a sealed container, the output charge being formed of a secondary explosive and being disposed in the sealed container, wherein the output charge is configured to detonate directly in response to energy released during detonation of the input charge.

18. The initiator assembly of claim 17, wherein the sealed container includes an annular wall, a bottom wall, which is fixedly coupled to the annular wall, and a lid portion that is fixedly secured to the annular wall.

19. The initiator assembly of claim 18, wherein the lid portion is received into the annular wall.

20. The initiator assembly of claim 19, wherein the sealed container exerts a compressive stress onto the output charge that is directed along an axis that is coincident with a longitudinal axis of the barrel aperture.

21. The initiator assembly of claim 19, wherein the annular wall defines a bore into which the output charge is received and wherein the lid portion is received in the bore.

22. The initiator assembly of claim 21, wherein the annular wall is deformed to inhibit withdrawal of the lid portion from the annular wall.

23. The initiator assembly of claim 18, wherein the output charge assembly further comprises a sealant that is disposed on the cup portion and the lid portion.

24. The initiator assembly of claim 18, wherein the annular wall and the bottom wall are integrally and unitarily formed.

25. The initiator assembly of claim 18, wherein the lid portion is bonded to the annular wall.

26. The initiator assembly of claim 17, wherein the output charge is formed as a plurality of pellets, each of the pellets being formed of a compacted powered material.

27. The initiator assembly of claim 26, wherein each of the pellets is compacted along an axis that is parallel to the longitudinal axis of the barrel aperture.

28. The initiator assembly of claim 17, wherein the initiator assembly is a detonator.

29. The initiator assembly of claim 17, wherein the sealed container has a first end, which is disposed proximate the input charge, and a second end that that is further from the input charge than the first end, and wherein the second end of the sealed container is configured to rupture when the output charge detonates.

30. The initiator assembly of claim 17, wherein a portion of the sealed container is unitarily and integrally formed with the cover.

* * * * *